United States Patent [19]

Duverne

[11] 4,413,433

[45] Nov. 8, 1983

[54] APPARATUS FOR EXTRACTING MUDDY MATERIALS AND FEEDING THEM TO A TREATMENT STATION

[76] Inventor: Jean-Claude M. Duverne, 18, rue des Processions, F91310 Montlhery, Linas, France

[21] Appl. No.: 327,581

[22] Filed: Dec. 4, 1981

[51] Int. Cl.[3] ..... E02F 3/06

[52] U.S. Cl. ..... 37/190; 37/54; 37/67

[58] Field of Search ..... 37/64–67, 37/54, 55, 58, 189, 190, DIG. 8

[56] References Cited

U.S. PATENT DOCUMENTS

| | | | |
|---|---|---|---|
| 1,002,602 | 9/1911 | Newman | 37/67 X |
| 1,055,371 | 3/1913 | Thorp et al. | 37/58 X |
| 2,031,388 | 2/1936 | Sensibar | 37/64 |
| 2,705,379 | 4/1955 | Fruhling | 37/81 |
| 2,801,479 | 8/1957 | Brauer | 37/66 X |
| 2,950,548 | 8/1960 | Ritscher | 37/67 |
| 3,010,232 | 11/1961 | Skakel et al. | 37/61 X |
| 4,109,336 | 8/1978 | Ford | 37/82 X |
| 4,217,212 | 8/1980 | Deal | 37/66 X |
| 4,311,342 | 1/1982 | Latimer | 37/DIG. 8 |

FOREIGN PATENT DOCUMENTS

| | | | |
|---|---|---|---|
| 693793 | 7/1940 | Fed. Rep. of Germany | 37/189 |
| 1087532 | 8/1960 | Fed. Rep. of Germany | 37/189 |
| 1111378 | 10/1955 | France . | |
| 1156016 | 12/1957 | France . | |
| 1254957 | 1/1961 | France . | |
| 1289625 | 2/1962 | France . | |
| 238420 | 1/1968 | U.S.S.R. | 37/66 |

*Primary Examiner*—Clifford D. Crowder
*Attorney, Agent, or Firm*—Rodgers & Rodgers

[57] ABSTRACT

Apparatus designed to extract and mix any muddy material from basins or deep morasses with steeply sloping banks and to feed such material in a relatively homogenous form by means of a pressurized propulsion pump integrated into the equipment to a remote treatment station. As seen from downstream to upstream, the equipment comprises a pump for propelling the extracted materials to a remote treatment station by means of a channel, an elevator to pick up the materials in an input bucket and dump them into a feed hopper of the pump, the input bucket bearing laterally two extraction screws and on its forward part an extracting apparatus capable of operating alone or jointly with the extraction screws.

5 Claims, 2 Drawing Figures

APPARATUS FOR EXTRACTING MUDDY MATERIALS AND FEEDING THEM TO A TREATMENT STATION

Figure 1:
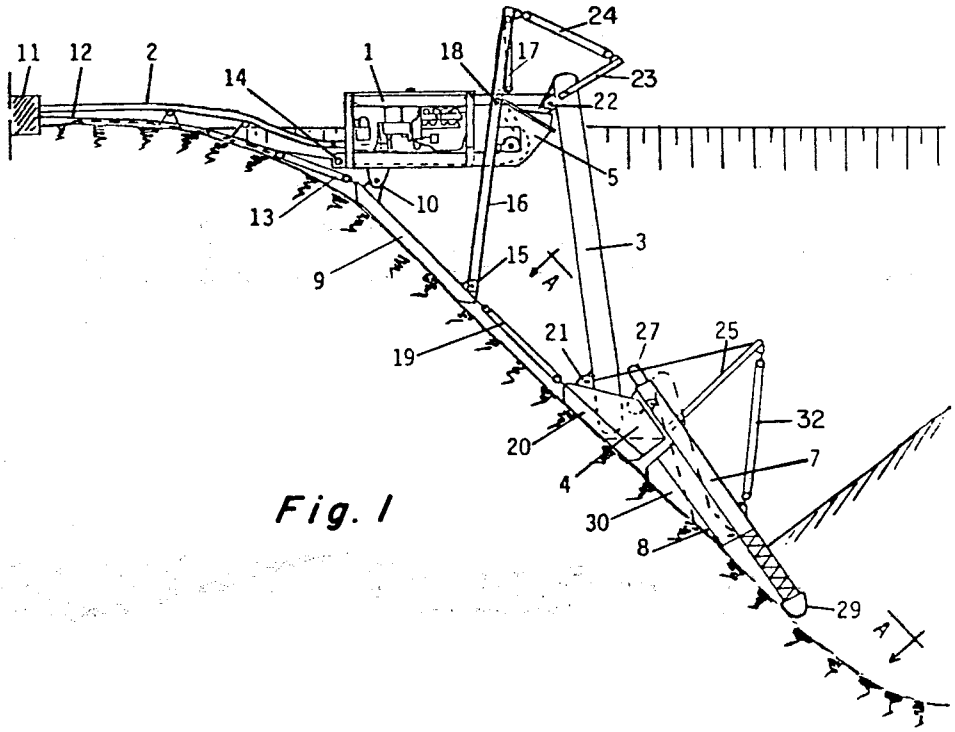

The present invention concerns apparatus for extracting muddy materials and feeding them to a treating station. More particularly, its object is to permit the extraction and mixing of any muddy material from basins or deep morasses with steep banks and to feed such mud in a relatively homogeneous form to a remote treatment station using a pressurized propulsion pump integrated with the apparatus.

In the present art, many types of mud extracting apparatus are known, among which are excavators, front end loaders, dredgers and scrapers. The choice of equipment is essentially determined by the consistency of the mud material in the extraction basin because the materials in some cases are more or less dry and cracked in the upper layers and increasingly soft and moist in the lower layers. Under such conditions, it becomes quite hazardous to move known equipment onto the extraction site because of the unforseeable possibility of miring and even collapse of the terrain under the equipment.

According to this invention means is provided to allow on-site extraction of muddy material, particularly under the above cited conditions, and to convey it homogeneously by propulsion and under pressure from the extraction site to a zemote treatment station located on firm ground.

More specifically, the apparatus includes a concrete type pump modified to propel the extracted materials toward their treatment station and at least one helical excavating and extraction screw mounted at one end on the input bucket so it can be laterally pivoted in both directions and lowered or raised in a vertical plane as needed. The input bucket is connected in an adjustable manner to the foundation of the pump and supports in hinging manner the lower end part of a hoisting and pick up apparatus for the materials disposed in it. The hoisting apparatus is mounted in a hinging manner at its upper end on the pump frame support to facilitate dumping of the materials into a feed hopper.

Also, in order to ensure that the equipment extract materials at a higher rate than is possible with a single screw, two screws are provided which are respectively mounted on the sides of the input bucket so that each can sweep through an angle of about 90° with respect to the longitudinal axis of the bucket. The bucket is designed to be mounted on a foundation in the form of a sled but capable of adaption to conventional tracks.

In addition the input bucket is also a pick up bucket for the extracted materials and is designed at its foreward part to support in a hinging manner an extraction or scraper device of the forward double transverse screw type with counterdirectional pitch. This extraction device is of a width substantially equal to that of the bucket and is capable of operating by itself or together with the two lateral extraction screws.

Moreover each extraction screw used in this apparatus is provided at its forward end with a rotating protective nose and comprises a bare part up to half its total length, while the rear half is enclosed in a tubular casing. Provided under each screw is an adjustable slab designed to constitute a screw support pad and simultaneously means for scraping and levelling the extraction site. The materials that are scraped and moved back by the equipment shaft are picked up by the forward collecting device of the bucket.

The pump foundation consists of a sled means or barge which supports, in a hinging manner at its rear end, the corresponding end of the pump support frame and at its front end, also in an articulating manner, a gantry means for hoisting the pump end of the feed hopper side. The gantry means is designed to place the pump in a horizontal position when its foundation is on a sloping bank at the extraction site. The foundation is secured against slippage by a lashing anchored in firm ground and which comprises a chain or cable hoist with the control winch located on the pump frame. Also the gantry means for placing the pump in the horizontal position is of a sufficient height that the foundation can rest on a bank of firm ground with a pronounced slope exceeding the slope of the natural embankment as high as about 80%.

The elevator apparatus connecting the extracted materials input and pick up bucket to the pump feed hopper may consist of a bucket elevator or of an encased helical screw of which the flow rate is selected to slightly exceed the total flow rates of the extraction screws and of the extracting apparatus at the front of the bucket. In some cases the elevator means may consist of a rigid framework hinged at the top and bottom in the same manner as the bucket elevator or the encased helical screw and supporting two suction pipes which dip by means of their lower ends into the input bucket and are designed at their upper ends to respectively communicate with each of the two pump pipes in relation to their suction sequences. In every case the elevator means comprises at its top a lever arm connected to the top of the gantry means to maneuver the pump into a horizontal position by means of a hoist acting as an inclination means and which complements the adjustable connecting means between the foundation of the pump and the input bucket in order to control the latter in its advanced position adjacent the materials to be extracted.

Other characteristics of the present invention will become clear when considered in relation to the description below which is an illustrative and nonlimiting embodiment of the apparatus for extracting muddy materials and feeding them to a treatment station and shown in schematic manner in the attached drawings.

Figure 2:
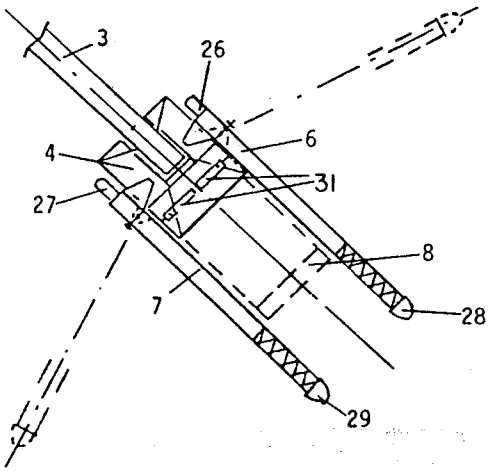

FIG. 1 is a schematic elevation of the apparatus according to this invention and FIG. 2 is a top view taken along line A—A in FIG. 1 and showing the extraction apparatus input and pick up bucket.

As shown in the drawings, the apparatus according to this invention can be operated to extract muddy materials from a basin with steeply sloping banks and can penetrate the basin without danger of being mired or of collapsing in the materials to be extracted. Obviously, in order to arrive at the position shown in the drawings, the equipment began the extraction process at the top of the bank and the penetration of the basin started when the extracting screws had stripped a substantial length of firm ground.

More specifically, the apparatus comprises pump 1 which propels the extracted materials to a remote treatment station by means of channel 2. Elevator apparatus 3 relays the materials by bucket 4 into feed hopper 5. Disposed on the sides of bucket 4 are two extraction screws 6 and 7 and disposed on its forward part is scraping apparatus 8.

As most clearly shown in FIG. 1, pump 1 is mounted on foundation 9 with hinge means 10 provided to allow pump 1 to lie in the horizontal position when the foundation 9, which is in the form of a sled or a barge and possibly provided with tracks, rests at an incline on the sloping bank. Foundation 9 is attached to anchoring means 11 by means of cable 12 and cable hoist 13. Also control winch 14 is located on the support framework of pump 1. Gantry means 16 is mounted on the front end of foundation 9 so as to pivot at point 15 and has at its head hoist 17 to lift the pump into its horizontal position. Even though the equipment is shown schematically, the uprights of gantry means 16 are in the form of slide means within which lateral rollers 18, which are fixed to the pump framework, ensure that gantry means 16 will be in a stable position at any attitude. Hoist 19 restrains bucket 4 and is secured to the front end of foundation 9.

In addition bucket 4 comprises bed plate 20 in the form of a sled or barge which may be rack equipped and which at its rear end supports the lower part of the elevator means 3 so as to pivot about point 21. The upper part of elevator means 3 articulates about point 22 on the framework of pump 1 in order to allow the extracted materials to be dumped into feed hopper 5. Also on the upper portion of elevator means 3, a lever arm 23 is connected by hoist 24 to the upper end of gantry means 16. Bucket 4 is advanced by pulling on hoist 24 and simultaneously releasing hoist 19. In order for pump 1 to descend down the slope, hoist 13 is released and foundation 9, which is connected to pump 1, is allowed to move down the slope. Then hoist 17 is activated, as necessary, to maintain pump 1 in its proper horizontal position.

Although elevator means 3 is shown in the drawings as a bucket elevator other means such as an encased helical screw or two suction pipes supported on a rigid frame and each communicating with the pump pipes could be utilized.

As shown more clearly in FIG. 2, extracting apparatus 8 and extraction screws 6 and 7 are pivotally mounted on bucket 4. Each of the screws 6 and 7 is laterally pivoted when actuated by respective jack means 31 so as to swing them through an arc of approximately 90° with respect to the longitudinal axis of the apparatus and to allow them to be easily lifted or lowered by respective hoists 32 secured at one end to gantry means 25 which in turn is supported by bucket 4.

Extraction screws 6 and 7 are rotatably actuated respectively by independent motors 26 and 27 and are provided respectively with protective and rotatable nose means 28 and 29. Each screw 6 and 7 is left bare at its forward extracting end and is encased over the balance of its length by a flow chute for conveying the extracted materials into the bucket 4. Each screw also comprises, underneath its encased part and ahead of bucket 4, a lower slab 30 which can be adjusted in height and is designed to act as a support skid for the screw as well as a terrain leveling and scraping means when the screw is disposed longitudinally next to the bucket. In this manner, the scraped materials thus themselves to be collected by the extracting apparatus 8.

Finally although the hoists shown in FIGS. 1 and 2 are of the block and tackle variety, other known hoist means can be used without modifying the features of the invention.

I claim:

1. Apparatus for extracting and feeding muddy materials to a remote treatment station and operable progressively from firm ground toward basins or deep morasses with steep sloping banks comprising at least one extraction and excavating screw, bucket means for receiving the materials extracted by said screw, elevator means for removing said extracted materials from said bucket means, pump means for receiving said materials from said elevator means and propelling it to toward said treatment station, wherein said pump means is supported on a foundation, said foundation supporting in a hinging manner at one end the corresponding end of said pump means and at the other end in a hinging manner a gantry, said gantry and said pump means being operably connected to maintain said pump means in a generally horizontal position, and said foundation being restrained from sliding by anchoring means secured in firm ground and comprising a cable, cable hoist and a control winch secured to said pump means.

2. Apparatus according to claim 1 wherein said bucket is supported on a sled connected in adjustable manner to said foundation and said elevator means is supported at one end in hinging manner to said sled and at the other end in an articulating manner on said pump means.

3. Apparatus according to claim 2 wherein said at least one extraction and excavating screw includes a pair of extraction and excavating screws pivotally mounted respectively on the sides of said bucket in such a manner that each one can sweep through an angle of approximately 90°.

4. Apparatus according to claim 3 wherein the rear portion of each of said extraction screws is encased and a slab disposed below each of said encased portions.

5. Apparatus according to claim 2 wherein a scraping apparatus is operably connected to the forward end of said bucket.

* * * * *